US005916517A

United States Patent [19]

Hackl et al.

[11] Patent Number: 5,916,517

[45] Date of Patent: Jun. 29, 1999

[54] NITROGEN-BEARING IRON-BASED ALLOY FOR MACHINE PARTS SUBJECT TO SLIDING FRICTION

[75] Inventors: Gerhard Hackl; Gunter Hochortler, both of Kapfenberg, Austria

[73] Assignee: Bohler Edelstahl GmbH, Kapfenberg, Austria

[21] Appl. No.: 08/553,870

[22] Filed: Nov. 6, 1995

[30] Foreign Application Priority Data

Nov. 4, 1994 [AT] Austria ..... 2051/94

[51] Int. Cl.[6] ..... C22C 38/30

[52] U.S. Cl. ..... 420/38; 420/69; 148/326

[58] Field of Search ..... 420/69, 37, 38; 148/326

[56] References Cited

U.S. PATENT DOCUMENTS 3,990,892 11/1976 Machi et al. ..... 420/69
4,150,978 4/1979 Schlatter et al. .
4,880,481 11/1989 Jerlich et al. .
4,966,751 10/1990 Kaede et al. ..... 420/69

FOREIGN PATENT DOCUMENTS 372983 12/1983 Austria .
392485 4/1991 Austria .
55-134159 10/1980 Japan ..... 420/37

*Primary Examiner*—Scott Kastler
*Attorney, Agent, or Firm*—Greenblum & Bernstein, P.L.C.

[57] ABSTRACT

A process for making and using machine parts which in their function are exposed to severe stress from sliding superficial friction and machine parts produced thereby are described. The parts are made from an iron-based alloy which includes the following elements, in weight %: 0.35 to 1.0, preferably 0.4 to 0.8% C; up to 1.0% Si; up to 1.6%, preferably 0.3 to 1.4% Mn; 0.10 to 0.35, preferably 0.12 to 0.29% N; up to 1.0, preferably up to 0.8% Al; up to 2.8% Co; 14.0 to 25.0, preferably 16.0 to 19.0% Cr; 0.5 to 3.0, preferably 0.8 to 1.5% Mo; up to 3.0, preferably up to 1.5% Ni; 0.04 to 0.4, preferably 0.05 to 0.2% V; up to 3.0% W; up to 0.18% Nb; and up to 0.20% Ti. The total concentration of carbon and nitrogen results in a value of at least 0.5% and at most 1.2%, preferably at least 0.61% and at most 0.95%, with the remainder being iron and metallurgically required admixtures for the production of machine parts. Plunger pistons and piston rings of the above alloy, may optionally contain superficial hard layers, have especially advantageous usage properties.

22 Claims, No Drawings

NITROGEN-BEARING IRON-BASED ALLOY FOR MACHINE PARTS SUBJECT TO SLIDING FRICTION

CROSS-REFERENCE TO RELATED APPLICATION

This application claims the priority under 35 U.S.C. 119 of Austrian Application No. A 2051/94, filed on Nov. 4, 1994, the disclosure of which is incorporated herein by reference in its entirety.

BACKGROUND OF THE INVENTION

1. Field of the Invention

The invention relates to the use of an iron-based alloy which includes nitrogen in amounts to harden the alloy for use in machine parts which are subject to severe stresses caused by sliding friction. Some of the preferred uses for the inventive alloys are in plunger pistons and piston rings.

2. Description of Background Information and Relevant Information

Machine parts that are exposed to high or primary stress from sliding friction, in particular superficial friction, are predominantly made of cast materials. Cast parts have the advantage of undergoing an essentially isometric change in shape upon a change of temperature (i.e., they expand and contract isometrically) and therefore are not abrasive in practical use. This is due to the fact that the cast parts have a largely random microstructure and a homogeneous microscopic hard-particle distribution, such as, e.g., carbide distribution, and an equally homogeneous soft matrix configuration. This kind of microstructure is especially advantageous at frictional surfaces, and it decreases both the forces of friction and abrasion of material, especially if the surface is inadequately or poorly and/or incompletely coated with lubricant. Slide bearings, cylinder bushings, piston rings and similar machine parts that are exposed to severe stress from sliding friction are therefore primarily produced from cast or sintered materials, especially iron-based alloys.

When the parts are additionally subject to corrosive stresses, as in the case, for instance, with plunger pistons or piston rings in internal combustion engines, as a result of positive displacement media, condensates or the like, it is necessary to provide high chromium content in the alloy. However, the other properties of the material that are needed for an appropriate function of the part must not be disadvantageously affected by the inclusion of chromium.

For machine parts exposed to sliding superficial friction, and especially for piston rings, the attempt has already been made to use deformed material, in other words, materials that have a band-like deformation structure. These deformed parts (i.e., parts made from deformed material), have a microtexture designed so that the parts expand and contract differentially with temperature changes, to better meet the demands made of them in practical use. The manufacture of deformed parts, however, requires a number of complicated process steps in order to establish a required form or size for the particular use and the desired material properties.

Piston rings of deformed materials, such as an alloy of DIN material number 1.4112 or material number 1.2361, can be produced by rolling and optionally drawing a profile wire. Then, the wire is quenched, tempered and wound or cold-deformed into a spiral. After required annealing, it is advantageous to wind up, or further deform the profile wire in order to at least partially reduce the cold deformation stresses or solidifications of this spiral preform, to make a piston ring spiral, optionally with a smaller radius than that of the particular piston ring diameter which the ring is designed for.

Preferably after a further stress-relieving treatment or annealing, the spiral, optionally made in a nonround form, is cut open essentially in the direction of the generatrix, and the individual rings thus formed are machined. A nonround form of the piston rings in the stress-relieved state can be chosen so that in their work position in the cylinder, they are pressed radially inward on all sides, and an essentially equally high specific contact pressure of the outer ring surface against the cylinder wall will be attained. The piston rings should have a hardness of 35 HRC or 45 HRC and especially above 40 HRC.

If after rolling and optionally cold-drawing to a desired cross-sectional profile, the precursor material is then thermally quenched and tempered to a requisite high hardness, for instance in a once-through or continuous operation, then the thus heat-treated material has low bending strength, and as a result cracks can sometimes occur when the profile wire is wound into a spiral. The highest possible demands are in fact made of the strength or cold deformation capacity of the material, and these demands are also affected by the profile geometry and by the form of the spiral. Often, expensive special annealing processes and/or annealing operations must be carried out in order to attain a high level of uniformity in this material property.

Before rewinding into a spiral form oriented to the particular piston diameter is done, however, an expensive annealing of the piston ring precursor material that relieves stress and increases its strength must be provided. Otherwise the cold deformation capability of the material would be exhausted, and this would inevitably lead to breakages of material.

To overcome these disadvantages, the attempt has already been made to reduce the carbon concentration of the alloy and thus to improve the bending strength of the quenched and tempered material. However, a reduced carbon content lessens the hardness and makes the usage properties, especially the sliding properties, of the piston rings substantially worse. Accordingly, this attempt has been generally unacceptable in practice. The attempt was also made to increase the bending strength of the material by alloying it with cobalt. This technique has long been known and used in the preparation of high-speed steel. Although some improvement was attainable as a result, nevertheless in many cases the increase in strength values was not adequately great, and the high cost of the cobalt alloy metal made this approach commercially disadvantageous as well. In addition, comparatively greater abrasion in deformed alloys was ascertained.

SUMMARY OF THE INVENTION

An object of the present invention is to avoid the disadvantages of the materials previously used for producing machine parts which in their function are exposed to severe stress from sliding superficial friction, through use of alloys that have high hardness, high bending strength and improved performance in use, while at the same time being cost-effective.

Another object of the invention is to create corrosion-resistant plunger pistons and corrosion-resistant piston rings with improved properties in practical use.

Other objects and advantages of the present invention and advantageous features thereof will become apparent as the description proceeds herein.

Included in the description is an iron-based alloy, comprising: 0.35% to 1.0% C; 0.0% to 1.0% Si; 0.0% to 1.6% Mn; 0.10% to 0.35% N; 0.0% to 1.0% Al; 0.0% to 2.8% Co; 14.0% to 25.0% Cr; 0.5% to 3.0% Mo; 0.0% to 3.0% Ni; 0.04% to 0.4% V; 0.0% to 3.0% W; 0.0% to 0.18% Nb; and 0.0% to 0.20% Ti; measured as a percentage of total weight of the alloy; wherein a total concentration of C and N is at least about 0.5% and no greater than about 1.2%; and the remainder of the alloy comprising iron and metallurgically required admixtures for the production of machine parts that in their function are exposed to severe stress from sliding superficial friction.

More preferably, the iron-based alloy comprises: 0.4% to 0.8% C; 0.3% to 1.4% Mn; 0.12% to 0.29% N; 0.0% to 0.8% Al; 16.0% to 19.0% Cr; 0.8% to 1.5% Mo; 0.0% to 1.5% Ni; and 0.05% to 0.2% V.

A process of using the iron-based alloy includes manufacturing at least one machine part from the iron-based alloy and installing the same to function under conditions of sliding friction. The machine part may be further subjected to corrosive conditions during functioning. Preferred examples of machine parts to be produced and used by the present invention are plunger pistons and piston rings. However, other machine parts which are subject to sliding friction and/or corrosive conditions may also be produced according to the present invention.

According to the present invention, a process of making a machine part for functioning under conditions of severe stress from sliding superficial friction, and in a corrosive environment, includes: forming the machine part from an iron-based alloy, comprising: 0.35% to 1.0% C; 0.0% to 1.0% Si; 0.0% to 1.6% Mn; 0.10% to 0.35% N; 0.0% to 1.0% Al; 0.0% to 2.8% Co; 14.0% to 25.0% Cr; 0.5% to 3.0% Mo; 0.0% to 3.0% Ni; 0.04% to 0.4% V; 0.0% to 3.0% W; 0.0% to 0.18% Nb; and 0.0% to 0.20% Ti; measured as a percentage of total weight of the alloy; tempering the machine part; and forming a hardened layer on at least a portion of a surface of the machine part.

The hardened layer may be made by forming a nitride layer on at least a portion of the machine part, or by forming a carbonitride layer on at least a portion of the machine part. Further, the hardened layer may be vapor deposited (PVD or CVD) as an aluminum-based carbide layer, a titanium-based carbide layer, an aluminum-based nitride layer, a titanium-based nitride layer, an aluminum-based oxide layer, or a titanium-based oxide layer.

The present invention discloses a machine part formed from an iron-based alloy, comprising: 0.35% to 1.0% C; 0.0% to 1.0% Si; 0.0% to 1.6% Mn; 0.10% to 0.35% N; 0.0% to 1.0% Al; 0.0% to 2.8% Co; 14.0% to 25.0% Cr; 0.5% to 3.0% Mo; 0.0% to 3.0% Ni; 0.04% to 0.4% V; 0.0% to 3.0% W; 0.0% to 0.18% Nb; and 0.0% to 0.20% Ti; measured as a percentage of total weight of the alloy; wherein a total concentration of C and N is at least about 0.5% and no greater than about 1.2%; and the remainder of the alloy comprises iron and metallurgically required admixtures for the production of machine parts that in their function are exposed to severe stress from sliding superficial friction.

More preferably, the disclosed machine parts comprise 0.4% to 0.8% C; 0.3% to 1.4% Mn; 0.12% to 0.29% N; 0.0% to 0.8% Al; 16.0% to 19.0% Cr; 0.8% to 1.5% Mo; 0.0% to 1.5% Ni; and 0.05% to 0.2% V. Preferred embodiments of the machine parts include a plunger piston comprising a hardened layer on at least a portion of an outer surface thereof, wherein the hardened layer is formed from the group consisting of: an aluminum-based carbide layer formed by PVD; an aluminum-based nitride layer formed by PVD; an aluminum-based oxide layer formed by PVD; an aluminum-based carbide layer formed by CVD; an aluminum-based nitride layer formed by CVD; an aluminum-based oxide layer formed by CVD; a titanium-based carbide layer formed by PVD; a titanium-based nitride layer formed by PVD; a titanium-based oxide layer formed by PVD; a titanium-based carbide layer formed by CVD; a titanium-based nitride layer formed by CVD; and a titanium-based oxide layer formed by CVD; and a piston ring for use in internal combustion engines, wherein the piston ring further comprises a hardened layer on at least a portion of an outer surface thereof which is primarily subject to stress from friction, the hardened layer comprising a nitride layer having a thickness of at least 0.05 mm, and preferably at least 0.2 mm.

DESCRIPTION OF THE PREFERRED EMBODIMENTS

The above objects are attained by means of the use of an iron-based alloy that contains the elements of carbon, silicon, manganese, nitrogen, chromium, molybdenum and vanadium and optionally also aluminum, cobalt, nickel, tungsten, niobium and titanium, on the condition that the total concentration of carbon and nitrogen results in a value of at least 0.5 and at most 1.2 weight percent, preferably at least 0.61 and at most 0.95, the remainder being iron and metallurgically required admixtures for the production of machine parts that in their function are exposed to severe stress from sliding superficial friction.

The advantages attained by the invention are that through that through making and using the inventive iron-based alloys, machine parts produced thereby have a substantially improved resistance, particularly to severe stress from sliding superficial friction.

A high material hardness is brought about by the prescribed combination of carbon and nitrogen, so that the absolute carbon content in the proposed alloy is lowered and thus the bending strength is increased. Intrinsically, the proportion of carbide and in particular of Cr carbides becomes lower as a result, and as a result the Cr concentration in the matrix is increased and the corrosion resistance of the material is substantially improved. Because of the nitrogen content, a particularly fine grained microstructure is also brought about, and growth of grains is largely prevented even at high hardness temperatures.

Entirely surprisingly, it has also been demonstrated that by means of a nitrogen content of at least 0.1 weight %, the friction wear is markedly reduced, with the most favorable values having been found with approximately 0.2 weight % of nitrogen in the alloy. The molybdenum content and especially the vanadium content in the alloy are important for a high hardness and strength of the material and for the usability of high tempering temperatures, in particular from 350 to 550° C.

The present alloys are especially favorable for use under corrosive conditions, since the reduced carbon content and high homogeneous chromium concentration, along with the elements of nitrogen and molybdenum has been found to synergistically bring about the corrosion resistance of the material by stabilizing the surface passive layer, despite frictional stress.

Due to the superb corrosion resistance and improved resistance to sliding superficial friction stress, the present iron-based alloy are favorable for use in making plunger pistons. Both for high corrosion resistance to acids, which can be formed in the course of cold starting of an engine, and their improved resistance to high sliding friction stresses and the sealing demands made of it, the present invention has proved to be especially advantageous for use in making piston rings. If, as has also been found, the machine parts made of the aforementioned alloy are at least partly provided with a coating of hard material, especially favorable (i.e., low) friction values are attainable.

For machine parts that have bending stresses in practical use, and in particular for piston rings, it is preferred if the iron-based alloy used according to the invention is at least partially provided with a surface nitride layer. Nitriding of the finished part, for instance a piston ring, can be done in the course of a tempering treatment and is thus an economically viable treatment. It is favorable if the alloy contains aluminum in this case, because this promotes the formation of a nitride film. Nitriding, by absorbing nitrogen, increases the volume of the material, thus decreasing the tensile stresses at the surface of the part subject to bending stress, or breaks down these stresses or converts them into compressive stresses, so that the danger of crack initiation is largely precluded. If the frictional surface of the part is nitrided or carbonitrided to at least a depth of 0.05 mm and preferably of more than 0.2 mm, high surface hardnesses and also extremely low coefficients of sliding friction are attained.

In accordance with a further object of the invention, a plunger piston, especially for positive displacement of corrosive media, is characterized in that it comprises an iron-based alloy comprising: 0.35% to 1.0% C; 0.0% to 1.0% Si; 0.0% to 1.6% Mn; 0.10% to 0.35% N; 0.0% to 1.0% Al; 0.0% to 2.8% Co; 14.0% to 25.0% Cr; 0.5% to 3.0% Mo; 0.0% to 3.0% Ni; 0.04% to 0.4% V; 0.0% to 3.0% W; 0.0% to 0.18% Nb; and 0.0% to 0.20% Ti; measured as a percentage of total weight of the alloy; wherein a total concentration of C and N is at least about 0.5% and no greater than about 1.2%; and the remainder of the alloy comprising iron and metallurgically required admixtures for the production of machine parts that in their function are exposed to severe stress from sliding superficial friction.

The plunger piston is further provided with a layer, applied by the PVD or CVD method, of carbide and/or nitride of the elements Al and/or Ti.

A piston ring according to the invention, in particular for internal combustion engines, is characterized in that it is formed of an iron-based alloy comprising: 0.35% to 1.0% C; 0.0% to 1.0% Si; 0.0% to 1.6% Mn; 0.10% to 0.35% N; 0.0% to 1.0% Al; 0.0% to 2.8% Co; 14.0% to 25.0% Cr; 0.5% to 3.0% Mo; 0.0% to 3.0% Ni; 0.04% to 0.4% V; 0.0% to 3.0% W; 0.0% to 0.18% Nb; and 0.0% to 0.20% Ti; measured as a percentage of total weight of the alloy; wherein a total concentration of C and N is at least about 0.5% and no greater than about 1.2%; and the remainder of the alloy comprising iron and metallurgically required admixtures for the production of machine parts that in their function are exposed to severe stress from sliding superficial friction.

Optionally, the piston ring has at least partially, in particular on the surface that is primarily stressed with friction, a nitride layer having a thickness of at least 0.05 mm, and preferably more than 0.2 mm.

Especially good mechanical material properties with expansion values over 5%, preferably of 7% and more, can be attained, if from a precursor material with a diameter of from 4 to 10 mm, the piston ring profile wire is, as known per se, produced in a multi-roll rolling system at a temperature below the AC1 temperature of the alloy, quenched and tempered in a continuous process, and subsequently further processed to form piston rings.

Both for Otto engines and preferably for Diesel engines, piston rings with the above characteristics have stood the test of time especially well, particular for short periods of operation with cold starting at the beginning each time, and substantially less material wear at reduced coefficients of friction has been attained.

Although the invention has been described with reference to particular means, materials and embodiments, it is to be understood that the invention is not limited to the particulars disclosed and extends to all equivalents within the scope of the claims.

What is claimed is:

1. An iron-based alloy, comprising:

0.35% to 1.0% C;
0.0% to 1.0% Si;
0.0% to 1.6% Mn;
0.10% to 0.35% N;
0.0% to 1.0% Al;
0.0% to 2.8% Co;
14.0% to 25.0% Cr;
0.5% to 3.0% Mo;
0.0% to 3.0% Ni;
0.04% to 0.4% V;
0.0% to 3.0% W;
0.0% to 0.18% Nb; and
0.0% to 0.20% Ti;

measured as a percentage of total weight of the alloy;

wherein a total concentration of said C and said N is at least about 0.5% and no greater than about 1.2%; and the remainder of the alloy comprising iron and metallurgically required admixtures for the production of machine parts that in their function are exposed to severe stress from sliding superficial friction.

2. The iron-based alloy of claim 1, comprising:

0.4% to 0.8% C;
0.3% to 1.4% Mn;
0.12% to 0.29% N;
0.0% to 0.8% Al;
16. 0% to 19.0% Cr;
0.8% to 1.5% Mo;
0.0% to 1.5% Ni; and
0.05% to 0.2% V.

3. A process of using the iron-based alloy of claim 1, comprising:

manufacturing at least one machine part from said iron-based alloy; and installing said at least one machine part to function under conditions of sliding friction.

4. The process of using of claim 3, further comprising:

subjecting said at least one machine part to acidic conditions during functioning.

5. The process of using the iron-based alloy of claim 3, wherein said manufacturing at least one machine part comprises manufacturing at least one plunger piston.

6. The process of using the iron-based alloy of claim 4, wherein said manufacturing at least one machine part comprises manufacturing at least one plunger piston.

7. The process of using the iron-based alloy of claim 3, wherein said manufacturing at least one machine part comprises manufacturing at least one piston ring.

8. The process of using the iron-based alloy of claim 4, wherein said manufacturing at least one machine part comprises manufacturing at-least one piston ring.

9. A process of making a machine part for functioning under conditions of severe stress from sliding superficial friction, and in a corrosive environment, comprising:

forming the machine part from an iron-based alloy, comprising:

0.35% to 1.0% C;

0.0% to 1.0% Si;

0.0% to 1.6% Mn;

0.10% to 0.35% N;

0.0% to 1.0% Al;

0.0% to 2.8% Co;

14. 0% to 25.0% Cr;

0.5% to 3.0% Mo;

0.0% to 3.0% Ni;

0.04% to 0.4% V;

0.0% to 3.0% W;

0.0% to 0.18% Nb; and 0.0% to 0.20% Ti;

measured as a percentage of total weight of the alloy;

tempering the machine part; and forming a hardened layer on at least a portion of a surface of the machine part.

10. The process of making a machine part according to claim 9, wherein said forming a hardened layer comprises forming a nitride layer on at least a portion of the machine part.

11. The process of making a machine part according to claim 9, wherein said forming a hardened layer comprises forming a carbonitride layer on at least a portion of the machine part.

12. The process of making a machine part according to claim 9, wherein said forming a hardened layer comprises vapor depositing an aluminum-based carbide layer on at least a portion of the machine part.

13. The process of making a machine part according to claim 9, wherein said forming a hardened layer comprises vapor depositing a titanium-based carbide layer on at least a portion of the machine part.

14. The process of making a machine part according to claim 9, wherein said forming a hardened layer comprises vapor depositing an aluminum-based nitride layer on at least a portion of the machine part.

15. The process of making a machine part according to claim 9, wherein said forming a hardened layer comprises vapor depositing a titanium-based nitride layer on at least a portion of the machine part.

16. The process of making a machine part according to claim 9, wherein said forming a hardened layer comprises vapor depositing an aluminum-based oxide layer on at least a portion of the machine part.

17. The process of making a machine part according to claim 9, wherein said forming a hardened layer comprises vapor depositing a titanium-based oxide layer on at least a portion of the machine part.

18. A machine part formed from an iron-based alloy, comprising:

0.35% to 1.0% C;

0.0% to 1.0% Si;

0.0% to 1.6% Mn;

0.10% to 0.35% N;

0.0% to 1.0% Al;

0.0% to 2.8% Co;

14. 0% to 25.0% Cr;

0.5% to 3.0% Mo;

0.0% to 3.0% Ni;

0.04% to 0.4% V;

0.0% to 3.0% W;

0.0% to 0.18% Nb; and 0.0% to 0.20% Ti;

measured as a percentage of total weight of the alloy;

wherein a total concentration of said C and said N is at least about 0.5% and no greater than about 1.2%; and the remainder of the alloy comprising iron and metallurgically required admixtures for the production of machine parts that in their function are exposed to severe stress from sliding superficial friction.

19. The machine part of claim 18, wherein said iron-based alloy comprises:

0.4% to 0.8% C;

0.3% to 1.4% Mn;

0.12% to 0.29% N;

0.0% to 0.8% Al;

16.0% to 19.0% Cr;

0.8% to 1.5% Mo;

0.0% to 1.5% Ni; and 0.05% to 0.2% V.

20. The machine part of claim 18, wherein said machine part comprises a plunger piston, said plunger piston further comprising:

a hardened layer on at least a portion of an outer surface thereof, said hardened layer being formed from the group consisting of: an aluminum-based carbide layer formed by PVD; an aluminum-based nitride layer formed by PVD; an aluminum-based oxide layer formed by PVD; an aluminum-based carbide layer formed by CVD; an aluminum-based nitride layer formed by CVD; an aluminum-based oxide layer formed by CVD; a titanium-based carbide layer formed by PVD; a titanium-based nitride layer formed by PVD; a titanium-based oxide layer formed by PVD; a titanium-based carbide layer formed by CVD; a titanium-based nitride layer formed by CVD; and a titanium-based oxide layer formed by CVD.

21. The machine part of claim 18, wherein said machine part comprises a piston ring for use in internal combustion engines; said piston ring further comprising:

a hardened layer on at least a portion of an outer surface thereof which is primarily subject to stress from friction, said hardened layer comprising a nitride layer having a thickness of at least 0.05 mm.

22. The piston ring of claim 21, wherein said hardened layer has a thickness of at least 0.2 mm.

* * * * *